United States Patent [19]

Johnson

[11] Patent Number: 4,768,532

[45] Date of Patent: Sep. 6, 1988

[54] UNDERWATER POOL CLEANER

[75] Inventor: Bruce R. Johnson, Sebastopol, Calif.

[73] Assignee: Jandy Industries, Novato, Calif.

[21] Appl. No.: 6,178

[22] Filed: Jan. 23, 1987

[51] Int. Cl.[4] ..... B08B 3/02

[52] U.S. Cl. ..... 134/111; 134/167 R; 15/1.7; 15/409

[58] Field of Search ..... 15/1.7, 409; 180/7.1, 180/7.3; 210/169; 134/111, 167 R, 168 R

[56] References Cited

U.S. PATENT DOCUMENTS

| | | | |
|---|---|---|---|
| 759,141 | 5/1904 | Thurman | 15/1.7 |
| 3,310,173 | 3/1967 | Sosower | 210/169 |
| 3,444,575 | 5/1969 | Martin | 15/1.7 |
| 3,860,518 | 1/1975 | Henricksen | 15/1.7 |
| 3,921,654 | 11/1975 | Pansini | 134/167 R |
| 4,064,586 | 12/1977 | Caron | 15/1.7 |
| 4,169,484 | 10/1979 | Bonigut et al. | 134/167 R |
| 4,589,986 | 5/1986 | Greskovics et al. | 15/1.7 |
| 4,652,366 | 3/1987 | Brooks | 134/167 R |

FOREIGN PATENT DOCUMENTS

| | | | |
|---|---|---|---|
| 756788 | 4/1967 | Canada | 15/1.7 |

*Primary Examiner*—Philip R. Coe
*Assistant Examiner*—Joseph S. Machuga
*Attorney, Agent, or Firm*—Melvin R. Stidham

[57] ABSTRACT

A low profile carriage is mounted on widely spread wheels to roll along the underwater surfaces of a swimming pool. The carriage is propelled by a high velocity stream of water projecting from a rearwardly directed thrust nozzle. There is a venturi restriction just forward of the thrust nozzle, creating a low pressure zone that induces flow of water through the bottom of the carriage, drawing in leaves and other debris. The water so drawn in passes through a screen, trapping the debris in a removable pod or bin depending from the carriage. The top of the carriage is relatively flat and the depending debris pod is curved downward to form an inverted air foil, whereby the pressure differential between the top and bottom of the carriage biases the carriage against the swimming pool surface traversed thereby.

12 Claims, 5 Drawing Sheets

UNDERWATER POOL CLEANER

BACKGROUND OF THE INVENTION

This relates to underwater pool cleaners of the type adapted to travel in random paths along the underwater surfaces of a swimming pool to pick up debris and to sweep minute particles therefrom.

Floating debris, such as leaves, twigs and the like are generally removed from residential and commercial swimming pools, by means of skimmers or openings at water level, which draw in and collect matter floating on the surface of the pool. Foreign matter suspended in the water, such as fine particles of soil, are separated out at a pool water filtration system conveniently located near the swimming pool. A main filter pump draws water from the surface skimmer, and from the bottom of the pool, to pass it through the filtration unit and then recirculate it back to the swimming pool.

While the skimmer removes much of the floating matter, and the filtration system removes a considerable amount of the fine matter in suspension, the systems together are generally incapable of maintaining a swimming pool sufficiently clean and clear for an extended period. As a result, periodic cleaning of the underwater surfaces by other means is generally required in order to maintain a satisfactory level of water cleanliness and clarity.

Commonly ued by pool owners and pool service contractors are various types of vacuum heads that are connected to the return line to the main pump and then attached to the end of a pole for movement by pushing and pulling the head along the underwater surfaces of the pool. While many pool owners would prefer to avoid the chore of so cleaning the pool manually, they also prefer to avoid the expense of employing a pool service company to do this on a regular and continuing basis. Accordingly, in recent years, swimming pool cleaning devices which operate automatically, have enjoyed increasing popularity.

For example, a pool cleaning device of the type disclosed in U.S. Pat. No. 3,032,044 has a buoyant body, which is connected by a flexible hose to the pool water circulation pump or to a booster pump. A horizontal nozzle propels the body along the surface of the pool, pulling sweep hoses, through which jets of water are issued, whereby the water jets, as well as the sweeping action of the hoses themselves, dislodge fine sediment from the pool surfaces to be suspended in the water and thereafter separated by the pool filtration system.

More recently, there have been developed a number of underwater pool cleaning devices for removal of larger particles and debris directly from the underwater surfaces of the pool. An example of such devices is shown in U.S. Pat. No. 3,822,754 and related U.S. Pat. Nos. 3,936,899 and 3,972,339. In these devices, a carriage moves along the bottom and side walls, collecting debris by means of a vacuum, the carriage being propelled by drive wheels. The drive wheels are, in turn, driven by a turbine against which a stream of water is directed. A more recent drive system of this general type is shown in U.S. Pat. No. 4,558,479.

While underwater pool vacuuming devices of the type described in these patents have proven very effective in dislodging and collecting leaves and other relatively large forms of debris, some problems have been encountered in jamming and even damaging the exposed drive trains. Moreover, booster pumps are generally required to deliver enough water under pressure to both drive the vehicle and produce enough vacuum to effectively sweep the underwater surfaces.

OBJECTS OF THE INVENTION

It is an object of this invention to provide an underwater pool cleaner that does not require a mechanical drive train.

It is a further object of this invention to provide an underwater pool cleaner, which is operated by a stream of water, both to move along the underwater surfaces of the pool and to retrieve leaves and other debris from such surfaces.

It is a further object of this invention to provide an underwater pool cleaner that utilizes water pressure to both vacuum and sweep the underwater surfaces of a swimming pool.

It is a further object of this invention to provide a swimming pool cleaner wherein a jet of water under pressure is employed both to propel the cleaner vehicle along underwater surfaces and to generate a vacuum that draws and traps debris.

It is a further object of this invention to provide an effective underwater pool cleaner that can be manufactured and offered for sale at relatively low cost.

Other objects and advantages of this invention will become apparent to those skilled in the art to which it pertains without departing from the spirit and scope of this invention, as defined by the claims appended hereto.

SUMMARY OF THE INVENTION

In accordance with this invention, there is provided a kite-shaped carriage of low profile having widely spaced wheels on which it can roll along the underwater surfaces of a swimming pool. At its trailing end, the carriage has a rearwardly directed thrust nozzle through which a relatively high velocity stream of water is directed to propel the carriage in a forward direction. Just forward of the thrust nozzle outlet is a venturi restriction through which the water jet is directed, creating a low pressure zone that induces flow of more water to draw in debris, from on an adjacent the underwater surface being traversed by the carriage. A flapper gate enables entry of the debris but prevents egress thereof during periodic reverse movements of the carriage. The carriage has a relatively flat upper surface and a depending, removable debris collector pod that has a downwardly curved bottom surface forming an inverted air foil. This tends to generate a low pressure zone to bias the undersurface of the carriage toward the underwater swimming pool surface, supplementing the pull of vacuum through the debris inlet opening at the foward portion of the debris collector pod.

DESCRIPTION OF PREFERRED EMBODIMENTS

The Embodiment of FIGS. 1 to 10

Figure 1:
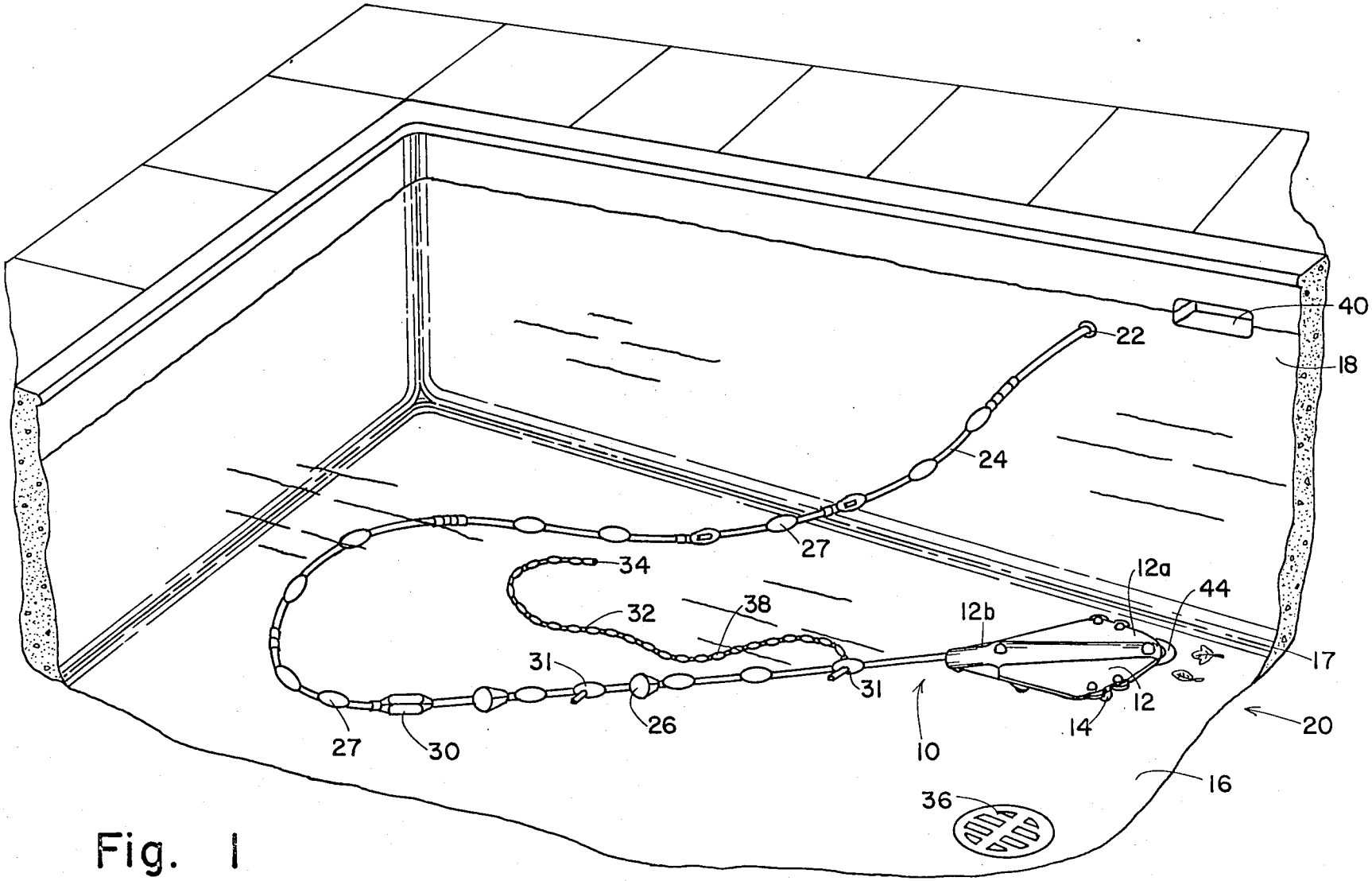
FIG. 1 is a view in perspective showing an underwater swimming pool cleaner embodying features of this invention moving along the bottom surface of a swimming pool.

Referring now particularly to FIG. 1, the underwater swimming pool cleaner 10 of this invention includes a kite-shaped, relatively flat carriage 12 that rolls on widely spaced wheels 14 to traverse the bottom surface 16, curved junctions 17 and vertical walls 18 of a swimming pool 20.

As will be described, the cleaner 10 is propelled by a stream of water under pressure from a pump (not shown). Specifically, a portion of the water from the filtration system pump, or from a booster pump (not shown) is delivered to a water outlet 22 in a side wall 18 of the swimming pool 20. A flexible hose 24 is connected at one end to the outlet 22 and at the other end to the pool cleaner carriage 12. The flexible hose may be provided with sea anchors 26 and floats 27 so that the hose will move along the bottom 16 of the pool with neutral buoyancy. Preferably, a reversing unit 30 is provided in the hose 24 so that the carriage 12 will be pulled in reverse periodically for a short period to prevent the carriage from being lodged in corners, steps or the like. Also to prevent the carriage from becoming lodged, lateral jets 31 are provided rearward of the carriage 12 to cause the trailing end of the carriage to swing laterally when it stops or slows down. These lateral jets 31 have little or no effect in normal operation when the carriage 12 is propelled forward in the manner to be described. However, should the carriage be hung up for any reason and the pull on the hose 24 relaxed, the resultant lateral movement of the trailing end will help to free the carriage. In addition, when the carriage 12 rolls up the curved transition 12 and up the side wall 18, it will be retarded by gravity. At that stage the lateral jets 31 turn the rear of the carriage 12 to one side so that the carriage turns around and down, back to the bottom surface 16.

In addition, a sweep hose 32 may be connected to the main hose 24 so that a jet of water issuing from the end 34 thereof will cause the sweep hose to whip back and forth acoss the bottom 16 of the pool to cause fine particles of dirt to be swept into suspension and carried to the filtration unit (not shown) through the main drain 36. Wear rings 38 are provided along the sweep hose 32 to prevent the hose from wearing through as it sweeps back and forth.

Floating debris is carried away to the filtration unit through a conventional skimmer 40. Hence, in operation, floating leaves and the like are carried away through the skimmer 40; suspended fine particles are carried away through the main drain 36; and larger leaves, sand and other debris are picked up and collected by the carriage 12, as will be described.

Figures 2, 3:
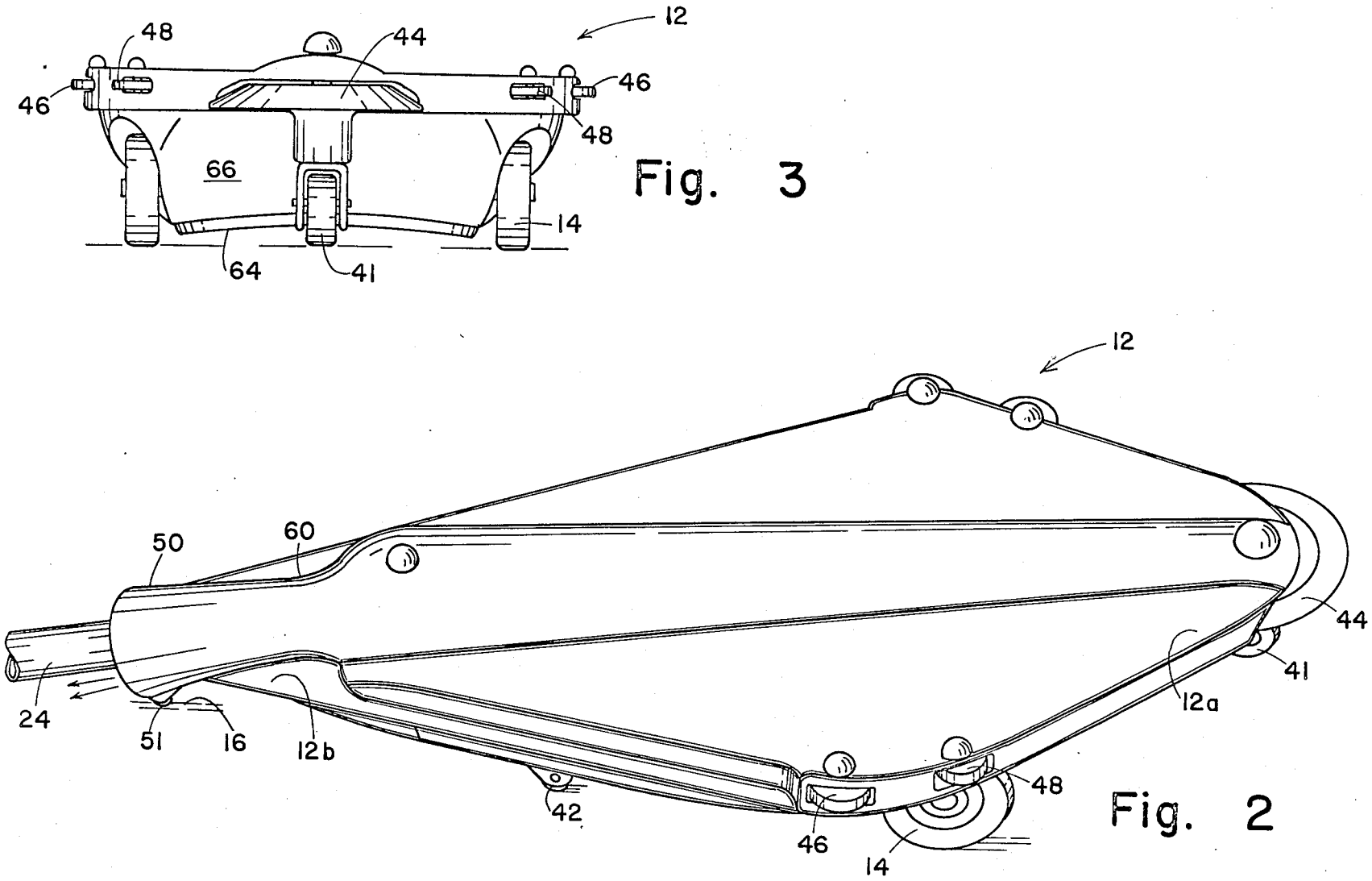
FIG. 2 is an enlarged view in perspective showing the debris collecting carriage of the pool cleaner.
FIG. 3 is a front view of the carriage.
Figure 4:
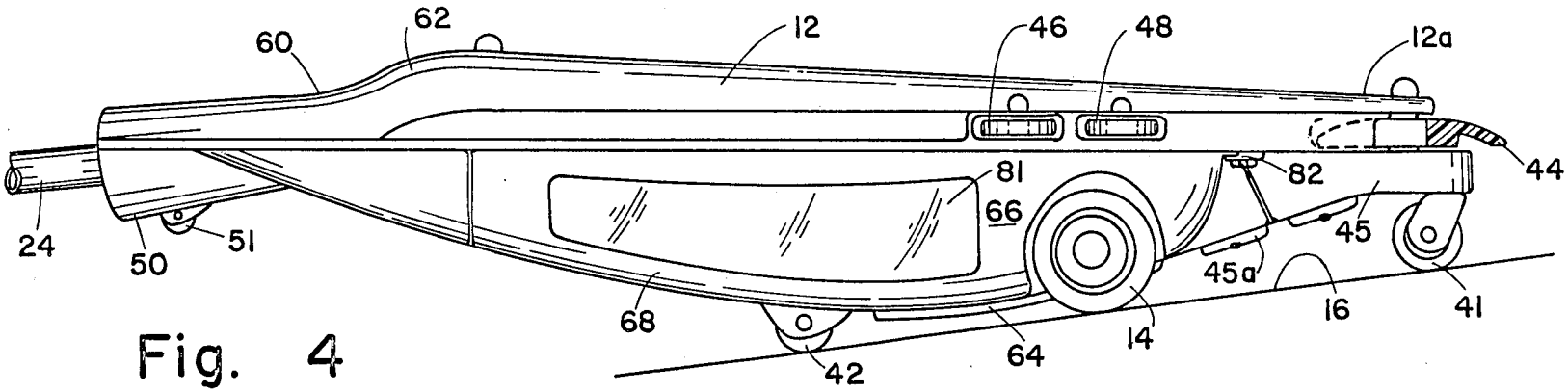
FIG. 4 is a side view of the carriage.

Referring now to FIG. 2, the carriage 12 is shown as being generally shaped in the form of a kite or diamond, with converging nose portion 12*a* and tail portion 12*b*, the carriage 12 rolling on main wheels 14 and front and rear swivel wheels 41 and 42. A generally horizontal nose deflector wheel 44 is provided to cause the carriage 12 to deflect laterally when it impacts with a step or other fixed obstacle. As shown in FIG. 4 the perimeter of the hose deflector wheel 44 is disposed at a suitable downward angle of, say about 45°, tending to bias the nose 12*a* downward as the carriage 12 is propelled through the water. Horizontal side wheels 46 and 48 are provided to enable the carriage 12 to move easily along an upright wall or step.

The carriage 12 is driven forwardly by jets of water issuing rearwardly as shown by the arrows in FIG. 2, the jets projecting through a rearwardly disposed thrust nozzle 50. A roller 51 (FIG. 4) may be provided on the underside of the thrust nozzle 50 to prevent friction drag on contact with the bottom 16 of the pool 18. Hence, the carriage 12 is propelled without any mechanical drive, avoiding the jamming problems attendant therewith. As shown, particularly in FIG. 4, the thrust nozzle 50 is preferably directed at a slightly downward angle so that the jets of water issuing from the thrust nozzle 50 also serve to agitate fine particles and stir them into suspension to supplement the action of the sweep hose 32. Further, the downward force vector tends to rotate the carriage 12 about the axis of its main wheels 14 to bias the nose 45 down against the pool surface.

Figure 5:
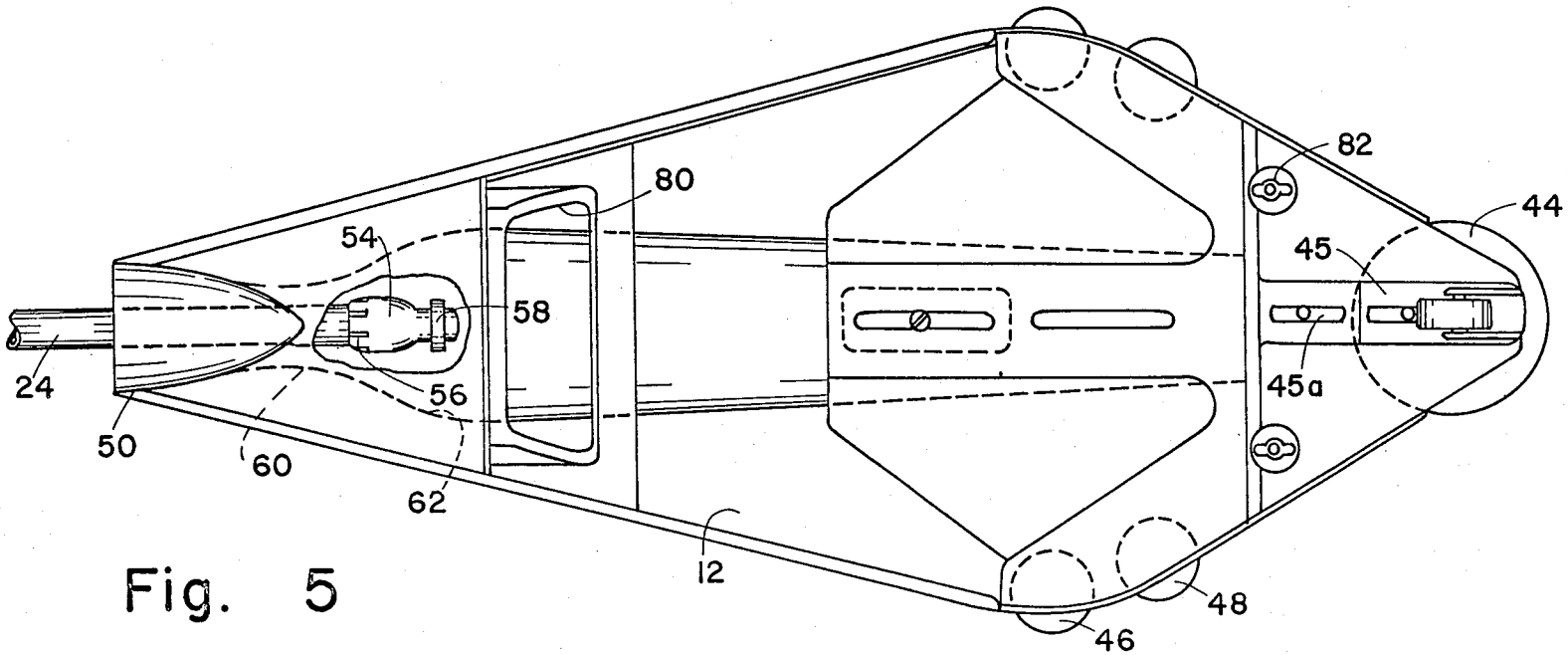
FIG. 5 is a bottom view of the carriage with the leave-collecting debris pod removed.
Figure 7:
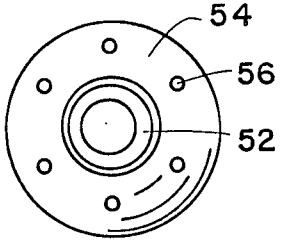
FIG. 7 is a rear view of the thrust-reversing nozzle.
Figure 6:
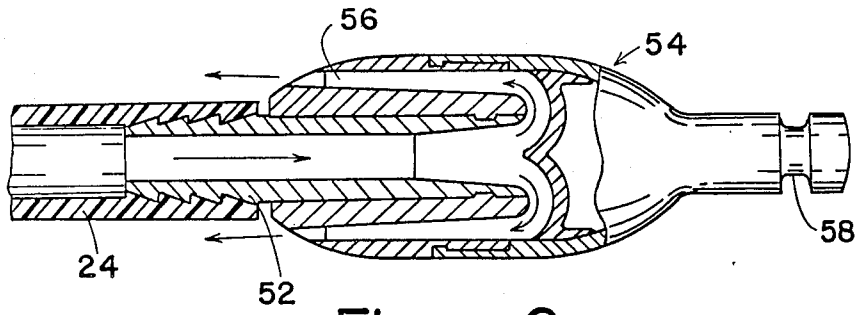
FIG. 6 is a side view, partially broken away, of the thrust-reversing nozzle that propels the carriage.

As shown more clearly in FIGS. 5, 6 and 7, the main, flexible hose 24 is connected to the intake 52 of a reversing nozzle 54 through which jets of water are projected through small jet openings 56 in the direction of the arrows. The reversing nozzle is secured within the carriage 12 by a swivel mounting 58 to prevent twisting of the hose 24.

Figure 9:
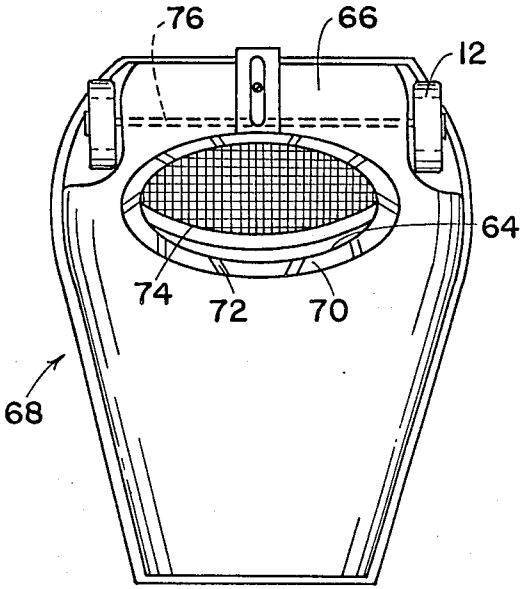
FIG. 9 is a plan view of the outside of the debris pod.
Figure 8:
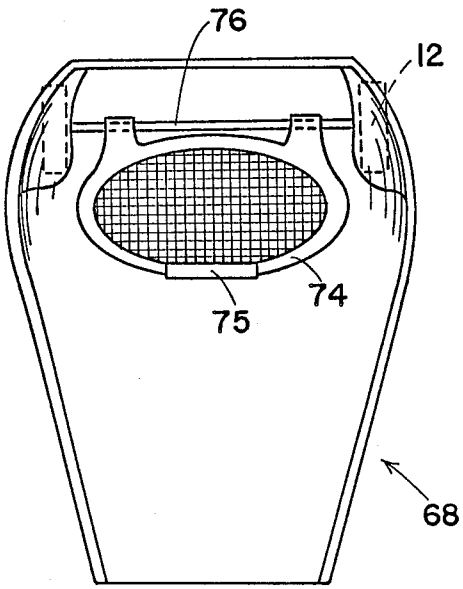
FIG. 8 is a plan view of the inside of the debris-collecting pod.
Figure 10:
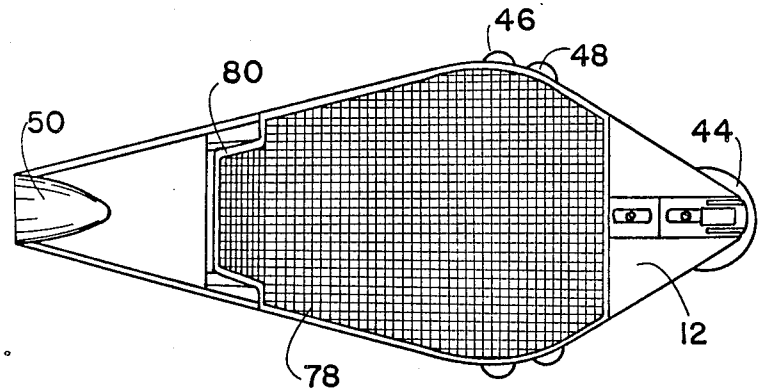
FIG. 10 is a bottom view of the carriage with debris pod removed and leaf-separating screen in place.

As shown best in FIG. 5, the reversing nozzle 54 is positioned in the carriage 12 just foward of a venturi restriction 60 in a flow passageway 62, which terminates in the thrust nozzle 50. Hence, in addition to propelling the carriage 12 without requirement of any mechanical drive, the reversing nozzle 54 also generates a low pressure area in the venturi 60 to induce the flow of more water, as well as debris, from the bottom surface 16 of the swimming pool. The water and debris are drawn into the housing 12 through an intake port 64 in the forward under surface 66 of a removable debris collecting pod 68 (FIGS. 8 and 9). A ridge 45 with replaceable wear bars 45*a* extends between the nose 12*a* and the debris pod 68 to prevent some obstacle, such as the hose 24 from haging up between the nose wheel 41 and the debris collection pod 68. Also as shown in FIG. 9, a lip 70 around the intake port 64 is provided with a plurality of angled grooves 72, which tend to create a swirling or whirlpool action to increase the suction through the flow passage 62. The intake port 64 is provided with a swing check screen or door 74 that is pivoted on the axis 76 for the main wheels 12 and normally biased toward closed position, as by means of a weight 75. The door 74 functions to enable leaves and other debris to flow into the housing 12, but to prevent egress therefrom, as when the carriage 12 is being pulled in reverse. A screen 78 that extends completely across the housing 12 (FIG. 10) above the debris pod 68, prevents leaves and other debris from moving out of the debris pod 68 with the stream of water flowing through the passageway port 80 and out the thrust nozzle 50.

In an alternate embodiment, a porous leaf collection bag could be secured around the thrust nozzle to collect debris while allowing the water to flow through. Such a bag would function both as a separator screen and as a collection receptacle.

However, in the preferred embodiment, when a quantity of leaves, sand and other debris have been collected within the carriage 12, the contoured debris pod or cover 68 may simply be removed to dump the debris. When collected such debris will be visible through clear windows 81 in the sides of the debris pod 68. In operation, the debris pod may be held on the carriage by means of suitable latches 82 (FIGS. 4 and 5).

As shown in FIG. 4, the carriage 12 is relatively flat on top and the contoured, removable debris pod 66 is of convex configuration to form an inverted air foil, creating a low pressure zone between the surface 66 and the underwater surface 16 of the swimming pool. Hence, as the carriage 12 moves along the underwater surface in random paths, it tends to be drawn to the underwater surface 16 by the inverted air foil configuration; by the downward force vector at the nozzle 50; and by the suction or draw at the intake opening 64.

In operation, the carriage 12 is propelled along the bottom 16 of the pool 20 by means of the thrust jet issuing from the nozzle 50. Because the thrust jet is directed slightly downward at an angle of, say five to ten degrees, and because the stream flowing rapidly through the venturi restriction 60 creates a vacuum, the nose 45 of the carriage is biased downwardly against the surface 16 to enhance the retrieval of debris. This action is supplemented by the angled diving plane of the nose wheel 44, and by the inverted air foil configuration of the carriage 12.

When the carriage 12 reaches the radius 17 at the junction of the bottom 16 and a side wall 18, it tends to climb right up the side wall wall. Then, as the carriage 12 slows by force of gravity the lateral jets 31 take effect and turn the tail 50 of the carriage directing it back down and around to the bottom surface, over which it again transverses in random fashion.

Figure 11:
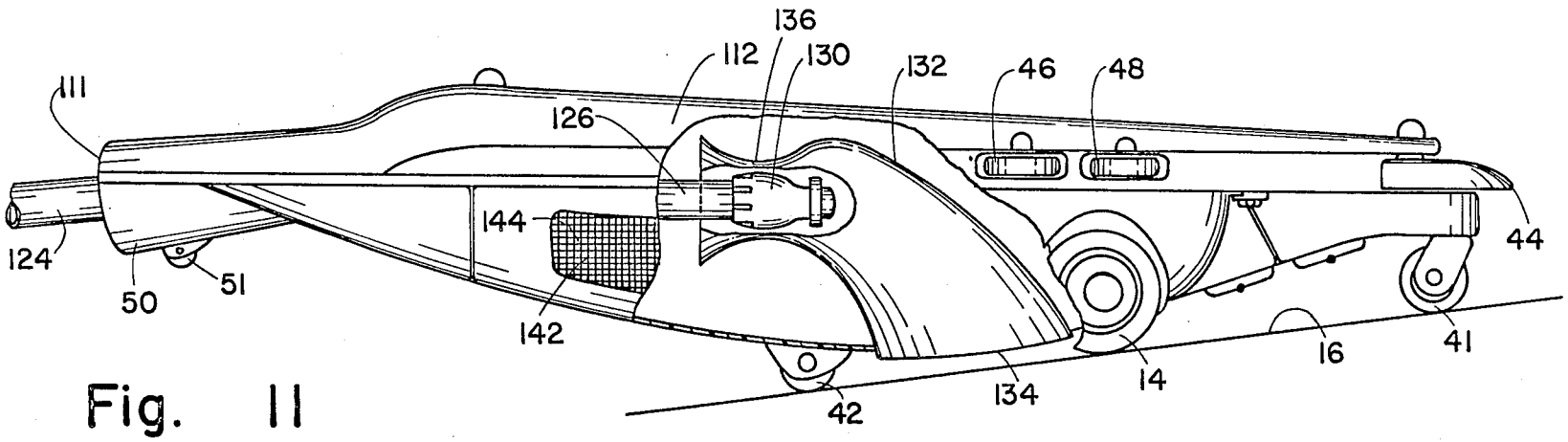
FIG. 11 is a side view of another emobiment of this invention.
Figure 12:
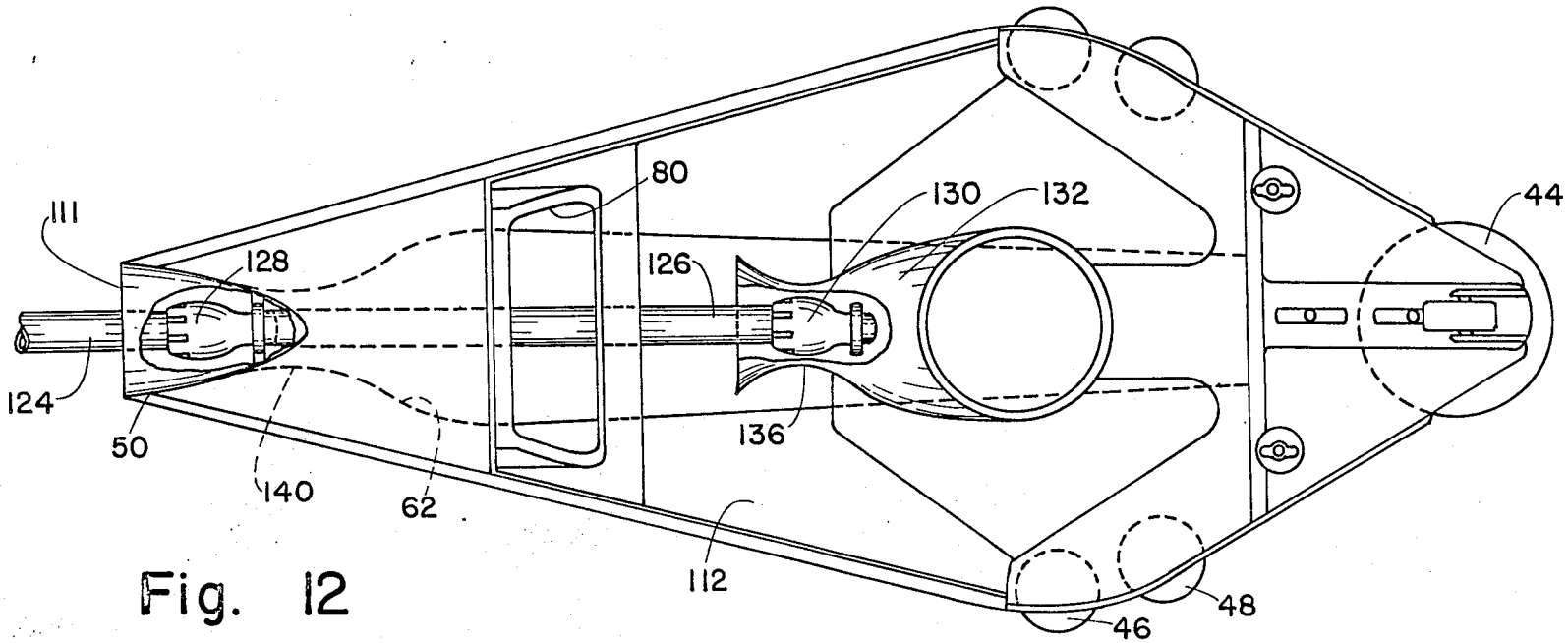
FIG. 12 is a bottom view of the embodiment of FIG. 11.

The Embodiment Of FIGS. 11 and 12

In this embodiment, a supply of water is delivered by a hose 124 to a manifold tube 126 where it is divided into two streams. One stream is delivered to a thrust jet nozzle 128, which is positioned at the rear 111 of the carriage 112 to provide the forward thrust for the carriage 128.

A second stream is delivered through the manifold tube 126 and then reversed through a flow inducement jet 130 that is positioned in a venturi tube or horn 132 that opens at 134 through the bottom of the carriage 112, converges to a venturi restriction 136 and then flares out to a discharge opening within the carriage 112. From within the carriage 112, the water may flow outward through the rear passage 140 and through suitable openings 142 in the trash receptacle, which are covered by screen 144 to trap sand, leaves and other particles.

Some of the fluid flowing out through the flow passageway 140 may provide some forward thrust, but the principal thrust is delivered through the thrust nozzle 128 located at the rear. Hence, one nozzle 128 provides the principal forward thrust and the other nozzle 132 produces the suction that cleans the bottom surfaces of the pool.

While this invention has been described in conjunction with a preferred embodiment thereof, it is obvious that modifications and changes therein may be made by those skilled in the art to which it pertains, without departing from the spirt and scope of this invention, as defined by the claims appended thereto.

What is claimed as invention is:

1. A pool cleaner adapted to travel along an underwater surface of a pool comprising:

a relatively flat, wing-like carriage conditioned to plane through the water;

a substantially horizontal thrust nozzle extending rearward from said carriage;

a flow passageway through said carriage;

screen means mounted in said carriage across said passageway to enable flow of water through said flow passageway, but to block passage of solids carried by said flowing water;

a water and debris intake port opening into said flow passageway from the forward bottom of said carriage;

means forming a venturi restriction in said flow passageway;

means for projecting a stream of water rearward through said venturi restriction to induce flow through said passageway;

a flexible hose extending forwardly through said thrust nozzle and into said carriage for delivering water from a source thereof to said thrust nozzle and said stream projecting means;

flapper valve means mounted on said carriage to enable inward flow only of debris through said intake port;

means biasing said flapper valve closed when there is no rearward flow of water through said passageway from said intake port to said thrust nozzle; and reverse propulsion means in said flexible hose operative periodically to divert flow of water from said stream projecting means and to pull said carriage rearward.

2. A pool cleaner adapted to travel along an underwater surface of a pool comprising:

a relatively flat, wing-like carriage conditioned to plane through the water, said carriage having a wide body portion tapering down gradually to a narrow tail portion;

main wheels on the underside of said carriage for rotation about a transverse axis near said wide portion to facilitate movement thereof along said underwater surface;

a flow passageway extending rearward through said carriage and terminating in a generally horizontal thrust nozzle at said tail portion;

screen means mounted in said carriage to enable flow of water through said flow passageway, but to block passage of solids carried by said flowing water;

a water and debris intake port opening into said flow passageway from the forward bottom of said carriage;

means forming a venturi restriction in said flow passageway; a jet nozzle forward of said venturi restriction for projecting a stream of water rearward through said venturi restriction and out said thrust nozzle to propel said carriage and to induce flow through said passageaway;

a flexible hose extending forwardly through said thrust nozzle and into said carriage for delivering water from a source thereof to said jet nozzle;

flapper valve means mounted on said carriage to enable inward flow only of debris through said intake port;

means biasing said flapper valve closed when there is no rearward flow of water through said passageway from said intake port to said thrust nozzle; and reverse propulsion means in said flexible hose operative periodically to divert flow of water from said jet nozzle and to pull said carriage rearward.

3. The pool cleaner defined by claim 2 including:

a horizontal nose wheel mounted on the forward end of said carriage to deflect said carriage upon engagement with an upright surface.

4. The pool cleaner defined by claim 2 including:

horizontal side wheels on said carriage to facilitate movement of said carriage along upright surfaces.

5. The pool cleaner defined by claim 2 wherein said carriage comprises:

a relatively flat, generally horizontal top surface; and a convex outer bottom surface curving down from said wide portion and then up to said tail portion forming an inverted air foil having a low center of gravity and conditioned to generate a low pressure zone beneath said bottom surface when said carriage is moving forwardly;

said intake port being located in said convex surface and said air foil being hollow to receive debris.

6. The pool cleaner defined by claim 2 including:

a removable debris container on said carriage upstream of said screen means.

7. The pool cleaner defined by claim 2 wherein:

said thrust nozzle is angled downward at a slight angle to agitate particles of debris on said underwater surface and to provide a small upward force vector to the tail portion of said carriage tending to lift said tail portion.

8. The pool cleaner defined by claim 2 including:

lateral, rearwardly angled jet nozzles in said flexible hose near said carriage producing lateral and forward force vectors against said flexible hose to the rear of said carriage to augment the pulling force of said thrust nozzle.

9. A pool cleaner adapted to travel along underwater surfaces of a pool comprising:

a kite-shaped low carriage to plane through the water with leading edges converging forwardly from a wing-like wide portion to a narrow nose portion and trailing edges converging rearwardly from said wide portion to a narrow tail portion;

widely spaced main support wheels mounted on the underside of said wide portion for rotation about a transverse axis;

said carriage having a relatively flat, generally horizontal top surface and a convex outer bottom surface curving down from said wide portion and then gradually up to said tail portion so that said carriage forms an inverted air foil having a low center of gravity and conditioned to generate a low pressure zone beneath said bottom surface when said carriage is moving forwardly;

a generally horizontal thrust nozzle extending rearward from said tail portion;

a flexible hose to be connected at one end to a water system, with the other end extending forwardly through said thrust nozzle and into said carriage;

a reversing nozzle on said other end of said hose for delivering water in a rearwardly and slightly downwardly directed high velocity stream back out through said thrust nozzle to propel said carriage forwardly;

lateral rearwardly angled jets in said hose near said carriage for imparting lateral and forward pulling forces to said hose to facilitate forward movement of said carriage;

a water and debris intake port opening into said carriage from the forward bottom thereof;

means for generating a low pressure zone within said carriage to draw water and debris through said intake port; and a debris catcher to trap debris drawn into said intake port.

10. The pool cleaner defined by claim 9 including a horizontal nose wheel mounted on said nose portion to deflect said carriage upon engagement with an upright surface.

11. The pool cleaner defined by claim 9 including:

horizontal side wheels on said wide portion to facilitate movement of said carriage along upright surfaces.

12. The pool cleaner defined by claim 9 wherein:

said thrust nozzle is angled downward at a slight angle to agitate particles of debris on said underwater surface and to provide a small upward force vector to said tail portion to rotate said nose portion downward about said transverse axis.

* * * * *